US006915612B2

(12) United States Patent
Oakley

(10) Patent No.: US 6,915,612 B2
(45) Date of Patent: Jul. 12, 2005

(54) WINDOW WELL WITH INCREASED IN-GROUND STABILITY

(75) Inventor: Brett Oakley, 6866 Chrisman La., Middletown, OH (US) 45042

(73) Assignee: Brett Oakley, Middletown, OH (US)

( * ) Notice: Subject to any disclaimer, the term of this patent is extended or adjusted under 35 U.S.C. 154(b) by 0 days.

(21) Appl. No.: 10/361,372

(22) Filed: Feb. 10, 2003

(65) Prior Publication Data

US 2003/0167705 A1 Sep. 11, 2003

Related U.S. Application Data

(60) Provisional application No. 60/356,047, filed on Feb. 11, 2002.

(51) Int. Cl.[7] ..... E04F 17/06; E04B 1/98

(52) U.S. Cl. ..... 52/107; 52/169.7; 52/169.6

(58) Field of Search ..... 52/107, 169.7, 52/169.6; 47/68, 72, 65.6

(56) References Cited

U.S. PATENT DOCUMENTS

| | | | | | |
|---|---|---|---|---|---|
| 300,654 | A | | 6/1884 | Smith | |
| 1,428,487 | A | * | 9/1922 | Dorr | 47/71 |
| 1,695,810 | A | | 12/1928 | Magill | |
| 1,840,397 | A | | 1/1932 | Keyes | |
| 2,316,712 | A | | 4/1943 | Prince et al. | |
| 2,793,688 | A | | 5/1957 | Robey | |
| 2,898,638 | A | | 8/1959 | Druckhamer | |
| 3,004,634 | A | | 10/1961 | Evans et al. | |
| D196,968 | S | | 11/1963 | Polhemus, Jr. | |
| 3,123,868 | A | | 3/1964 | Gust | |
| 3,151,416 | A | * | 10/1964 | Eakin et al. | 52/741.12 |
| 3,262,487 | A | | 7/1966 | Gustafson | |
| 3,703,791 | A | | 11/1972 | Slade | |
| 3,844,076 | A | | 10/1974 | Shock | |
| 3,848,378 | A | * | 11/1974 | Witte | 52/184 |
| 3,999,334 | A | | 12/1976 | Webb | |
| 4,226,062 | A | * | 10/1980 | Doane | 52/169.6 |
| D262,492 | S | | 12/1981 | Mackes | |
| 4,473,974 | A | * | 10/1984 | Orii et al. | 52/21 |
| 4,704,828 | A | | 11/1987 | Kemp | |
| 4,706,423 | A | * | 11/1987 | Cariteau et al. | 52/169.7 |
| 4,876,833 | A | | 10/1989 | Gefroh et al. | |
| 4,896,467 | A | | 1/1990 | McGinnis | |
| 4,921,339 | A | | 5/1990 | Brischke | |
| 4,924,628 | A | | 5/1990 | Ruby et al. | |
| 4,932,453 | A | | 6/1990 | Hoover et al. | |
| 5,042,199 | A | | 8/1991 | Schneider et al. | |
| 5,234,309 | A | * | 8/1993 | Foster | 414/525.9 |
| 5,339,579 | A | | 8/1994 | Woodyer et al. | |
| 5,590,493 | A | * | 1/1997 | Wilson | 52/108 |
| 5,647,154 | A | | 7/1997 | Groves | |
| 5,657,587 | A | | 8/1997 | Gefroh | |

(Continued)

OTHER PUBLICATIONS

Boman Kemp Mfg. Brochure.
Egress Window Well Systems Brochure.

*Primary Examiner*—Peter M. Cuomo
*Assistant Examiner*—Sarah C. Burnham
(74) *Attorney, Agent, or Firm*—Wegman, Hessler & Vanderburg

(57) ABSTRACT

Window well assembly of the type adapted for below soil grade attachment to a foundational structure adjacent a basement window or the like. The assembly includes a bottom member adapted to provide a drainage site, and an upstanding generally arcuately shaped wall surrounding said bottom member and having a pair of laterally opposed upstanding edge boundaries. The upstanding wall has an interior surface facing said basement window and exterior surface facing away from the window for anchoring the assembly in said soil. The exterior surface comprises at least one arcuately shaped gripping rib. Each gripping rib comprises an inclined protruding top wall sloping upwardly proceeding radially inwardly from the exterior surface toward the interior and a generally horizontal bottom wall.

3 Claims, 5 Drawing Sheets

U.S. PATENT DOCUMENTS 5,787,641 A * 8/1998 Watkins ..... 47/73
D403,436 S 12/1998 Gregory
5,881,503 A 3/1999 Eichelberger
5,970,664 A 10/1999 Janesky
D425,207 S 5/2000 Sharpe et al.
6,298,631 B1 10/2001 Finley
D466,221 S 11/2002 Oakley
6,484,455 B1 * 11/2002 Poole ..... 52/107
D472,978 S 4/2003 Oakley
2002/0174599 A1 * 11/2002 Rose ..... 47/65.6

* cited by examiner

WINDOW WELL WITH INCREASED IN-GROUND STABILITY

CROSS-REFERENCE TO RELATED APPLICATIONS

Priority filing benefit of U.S. Provisional Application Ser. No. 60/356,047 filed Feb. 11, 2002 is hereby claimed.

FIELD OF THE INVENTION

Window well structures having improved in-ground stability are disclosed.

BACKGROUND OF THE INVENTION

Integral, molded window well structures have become increasingly popular to provide additional light and enhanced view to basement areas. These structures are usually positioned below soil grade and, in some instances, can even facilitate egress from the basement area due to the provision of built-in ladders or steps in the structure facing the window.

These structures are normally bolted or otherwise fastened to the building foundation and held in place by back filling of soil or gravel around the exterior of the window well structure. Settlement of the gravel can often result in shifting of the structure resulting in improper alignment and possible leakage around the interface between the foundation and the window well. In some cases damage, cracking or other to the window well structure itself may occur.

The present invention therefore is directed to an integral, molded window well structure of the type described above in which improvement is made in the anchoring surfaces of the window well to enhance in-ground stability of the structure.

SUMMARY OF THE INVENTION

In accordance with the invention, a window well assembly is provided and adapted for below soil grade attachment to a foundational structure such as a poured concrete or cinder block wall or the like that may be located adjacent a basement window or the like. When viewed from top plan, the structure is in the form of a general semicircle with an integral attached floor member, which floor member may be provided with a drain or the like.

The floor member is surrounded by an upstanding wall member having a generally semi-circular shape when viewed in plan and has a pair of laterally opposed axially extending edge boundaries. The upstanding wall comprises an interior surface for facing the basement window and an exterior surface facing away from the window.

Backfilled soil or gravel is normally compacted around the exterior surface of the upstanding wall to firmly fix the structure in its below grade disposition adjacent the window. Bolts or other fastening means are utilized to secure the structure to the foundation.

The exterior surface of the upstanding wall is provided with generally arcuately shaped gripping rib members. The rib members have a specific sloping configuration so that an angular force is exerted on the structure upon the back filling operation so that the soil or gravel will more readily move the structure adjacent the foundation wall. Additionally, upon shrinkage or contraction of the gravel, the specifically configured surfaces of the gripping ribs serve to provide a desirable force vector to the structure, moving the structure into alignment adjacent the foundation.

In accordance with one aspect of the invention, at least two sets of arcuately shaped gripping ribs are provided on the exterior surface of the upstanding wall. Each set is circumferentially spaced from the other set leaving an axially extending channel on the exterior wall therebetween. Each set of gripping ribs comprises a plurality of axially spaced rows of gripping ribs. Each of the gripping ribs comprises an inclined top wall member that slopes upwardly proceeding radially inwardly from the exterior of the structure towards the interior. The ribs further have a generally horizontally disposed bottom wall member and an inclined intermediate wall connecting the top and bottom wall members.

In another aspect of the invention, the bottom of the window well incorporates a plurality of raised fins or ribs that extend horizontally along the bottom wall to impart additional strength to the structure and to provide a plurality of drainage channels leading to the drain.

The invention will be further explained in conjunction with the attached drawings.

IN THE DRAWINGS

FIG. 4 is an elevation view of the inside surface of the window well adapted for facing the basement window or the like;

DETAILED DESCRIPTION OF THE PREFERRED EMBODIMENT

Figure 1:
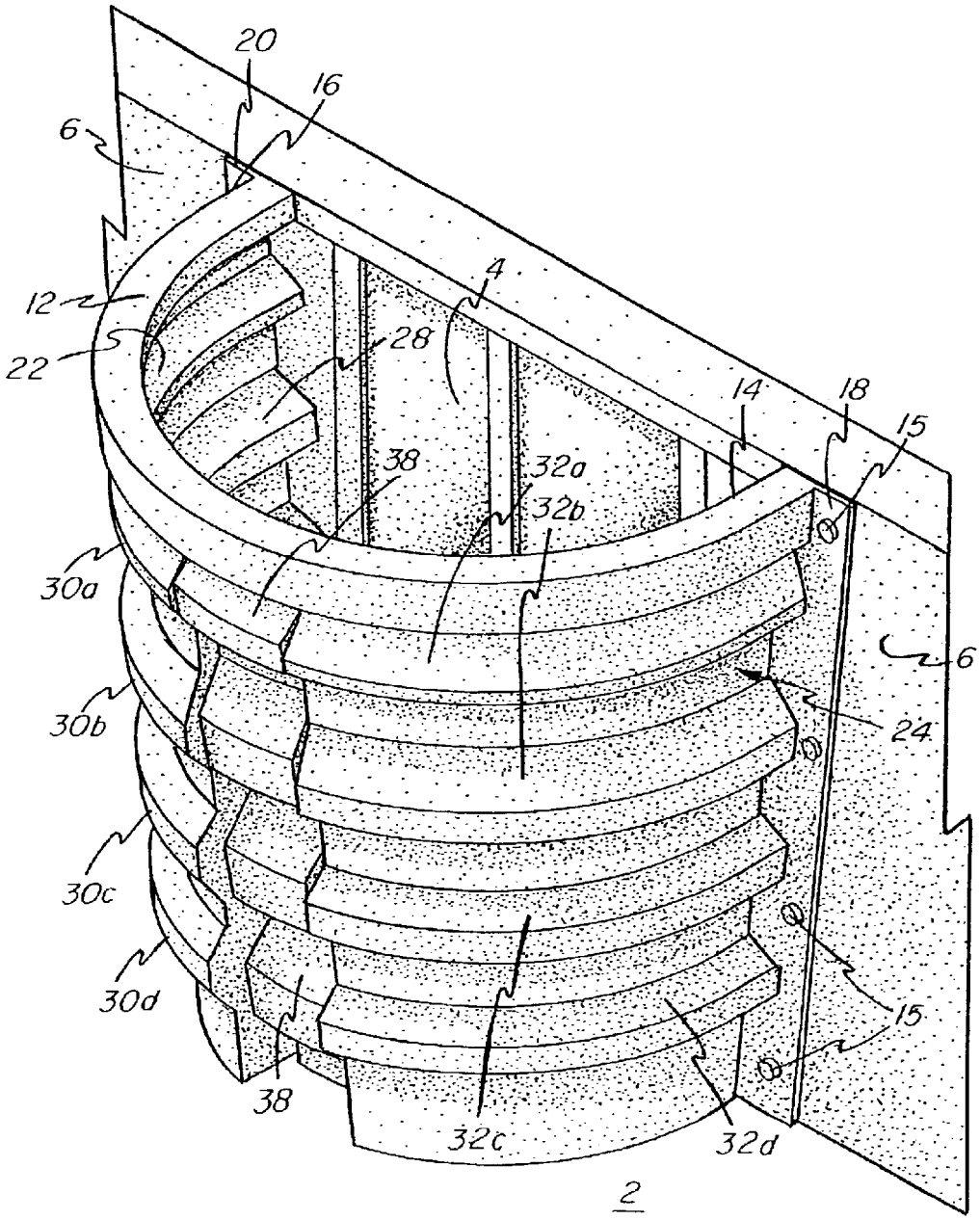
FIG. 1 is an isometric view of the integral window well structure shown in its intended position mounted adjacent a basement window.

Turning first to FIG. 1 of the drawings, there is shown a window well assembly 2 of the present invention. Here, the assembly is an integral molded structure that can be made from a variety of thermoplastic and thermoset polymers preferably from polyethylene with a UV inhibitor dispersed throughout the polymer matrix. At present, it is preferred that the assembly be formed via rotational molding techniques. The assembly 2 is shown in position adjacent basement window 4 via mounting with bolts 15 or the like to the concrete foundation 6. With respect to FIGS. 5 and 6, it can be seen that the assembly comprises an integral bottom member 8 with associated drain 10.

Figure 5:
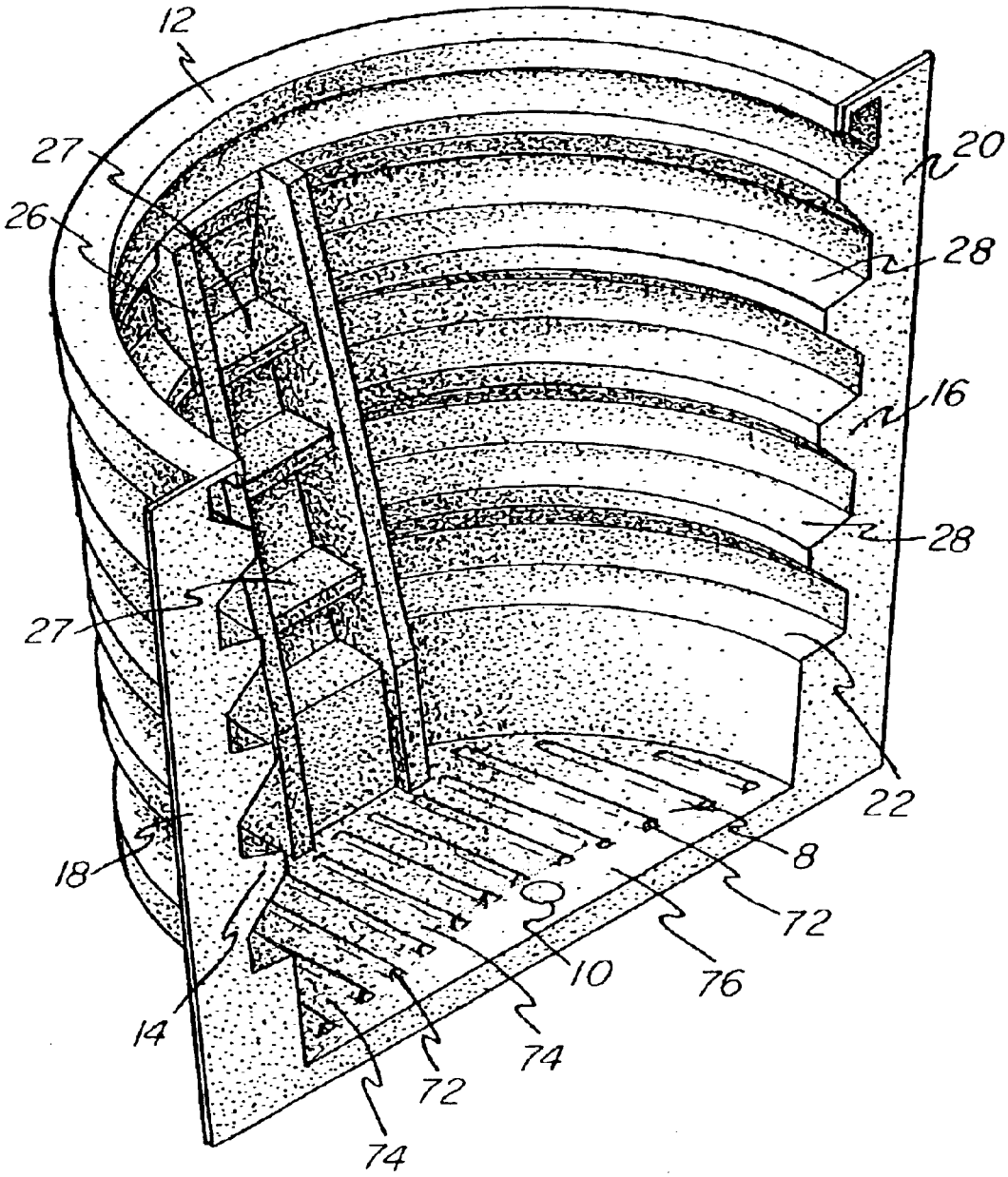
FIG. 5 is a perspective view taken of the inside of the window well structure.

Turning to FIGS. 1 and 5 of the drawings, the integral member comprises an upstanding wall 12 having axially extending edge boundaries 14,16 and associated integral mounting flanges 18,20.

The interior surface 22 facing the window may be provided with a plurality of ledges or shelves 28 so as to provide a convenient support for plants or other desired items. As shown, these ledges slant radially inwardly so that water will move toward the drain. An integral ladder 26 is provided in the interior face as is conventional in the art. The ladder 26 provides for egress from the basement area through the window 4 and comprises a series of rungs 27 which slope radially inwardly toward the drain. (See FIG. 5).

Figure 3:
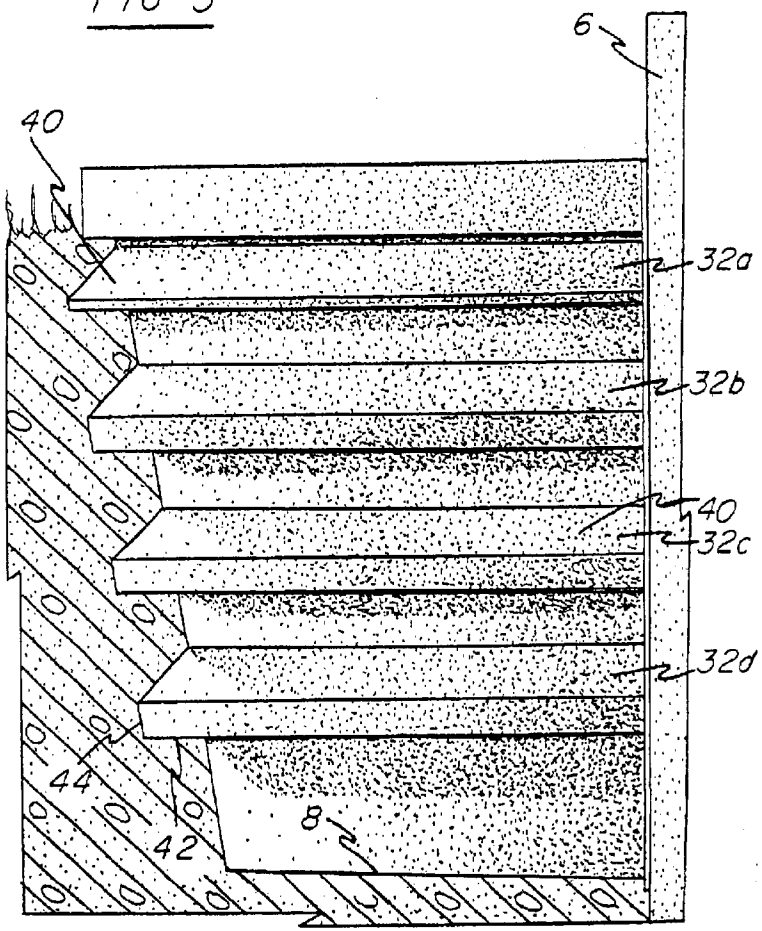
FIG. 3 is a side elevation view of the structure taken from the right-hand side of the structure shown in FIG. 1, with back filled earth being shown adjacent the structure.
Figure 2:
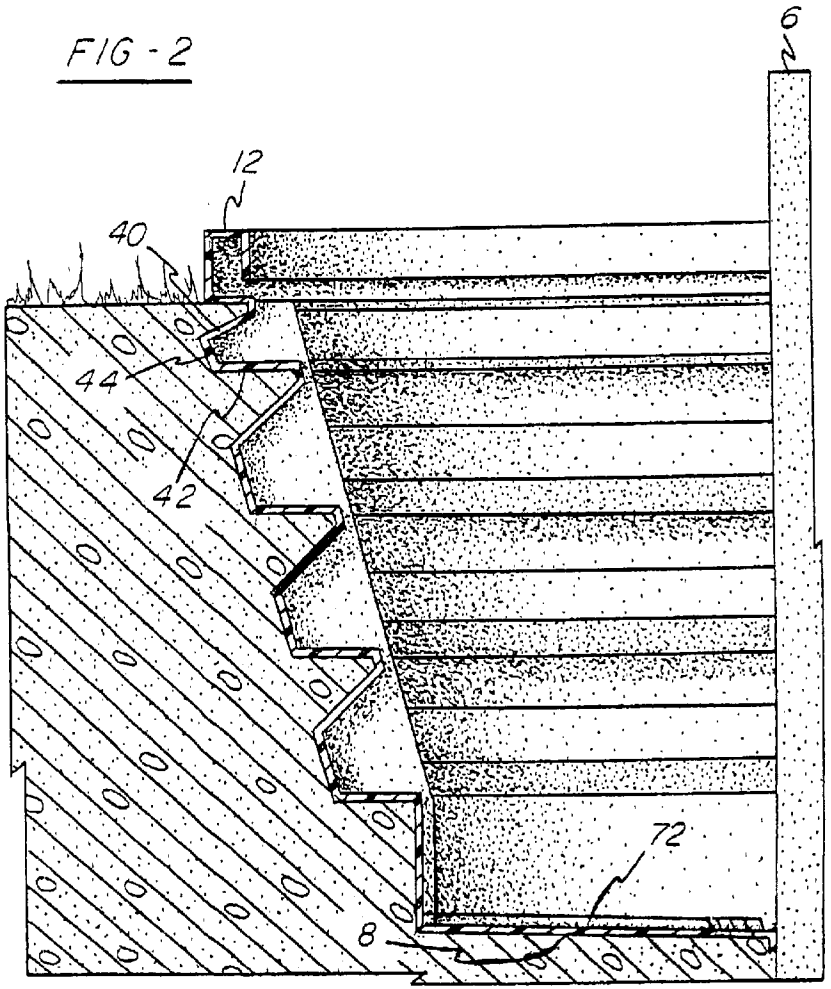
FIG. 2 is a cross-sectional view of the window well structure taken from the right-hand side of the structure shown in FIG. 1, but showing the structure in place after back filled gravel or earth has been compacted along the exterior of the window well.
Figure 4:
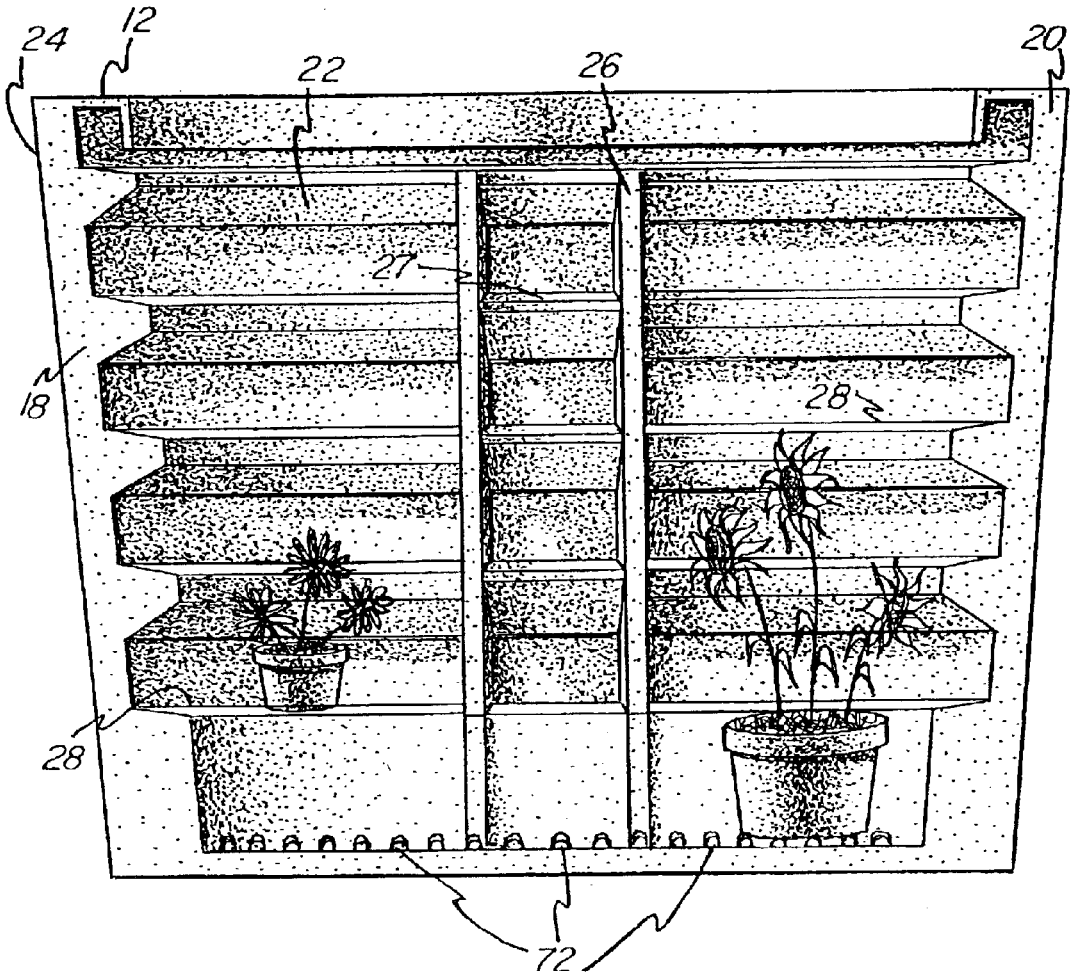
Figure 6:
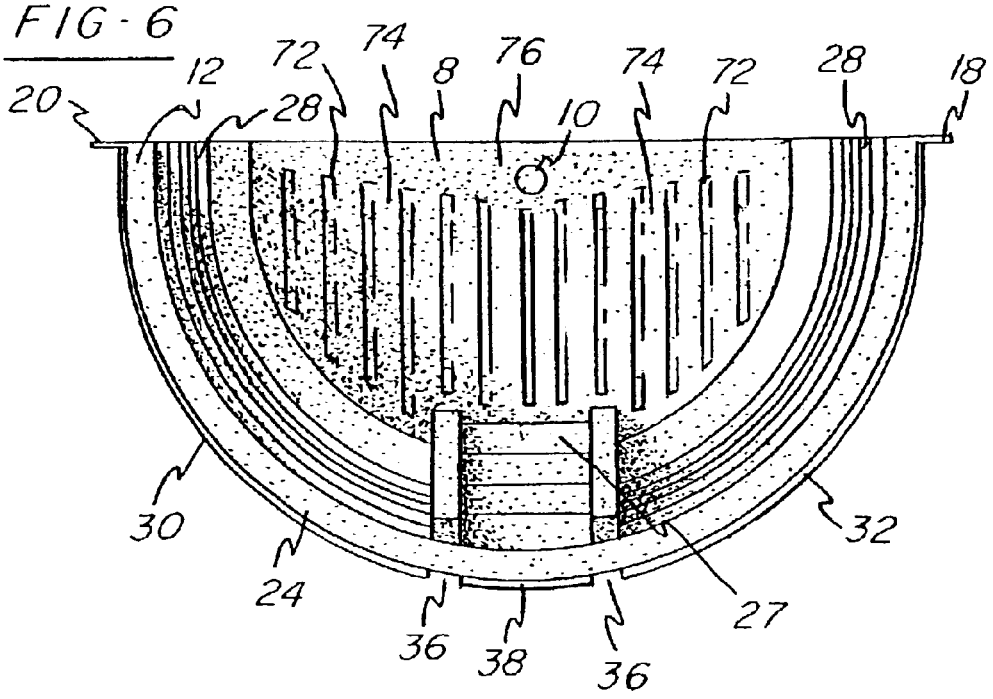
FIG. 6 is a top plan view of the window well structure.

Generally, the upstanding wall is in the form of a semicircle as can be best seen in FIG. 6. The exterior surface 24 of the wall comprises a first set 30 of arcuately shaped gripping rib members, and a second set 32 of arcuately shaped gripping rib members. The gripping rib members in each set are arranged in a plurality of rows 30 *a,b,c,d,* and 32 *a,b,c,d* as can be best seen in FIG. 1. An intervening space 36 axially extends between and separates the sets 30,32 from each other. As can be best seen in FIGS. 2 and 3, the ribs, 30,32 are each provided with top wall members 40 and bottom wall members 42 connected via wall intermediate members 44. The top walls 40 slope upwardly proceeding radially inwardly from the exterior towards the interior direction. This inclination is generally on the order of about 30–55° relative to a horizontal plane passing through the structure parallel to the bottom wall. Most preferably, the angle of inclination of the top wall 40 is about 45°. The angle of and direction of the slope of the top wall helps to provide an angular, inwardly based vector when the earth or gravel is back filled or compacted along the exterior of the structure, thereby helping to move the structure toward the foundation 6 and secure the structure thereto. At the same time the flat or level bottom wall 42 provides an uplifting force or vector on the soil to aid proper axial alignment of the window well assembly 2 along the foundation 6.

In one embodiment of the invention and as can be seen in FIGS. 1 and 6, the axially extending space existing between the first and second set of ribs is provided with radially protruding fin members 38 that also have a sloping top wall extending upwardly in a radial inward direction proceeding from the exterior towards the interior. This additional set of gripping members further aids in alignment stability. Also, as best shown in FIG. 1, the rows of gripping ribs 30 in one set are coplanar with regard to corresponding rows of the gripping ribs 32 in the other set.

As can be seen best in FIGS. 5 and 6, the bottom of the window well is provided with a plurality of generally horizontally extending ribs 72 that extend from the wall 12 toward the drain 10. These ridges or raised portions of the bottom wall give additional strength to the structure and also define a plurality of channels 74 to facilitate flow to the drain 10. As shown, the ribs terminate in a chevron-shaped pool 76 surrounding the drain.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. Window well assembly of the type adapted for below soil grade attachment to a foundational member adjacent a basement window said assembly comprising an integral molded structure and having a bottom member adapted to provide a drainage site, an upstanding generally arcuately shaped upstanding wall connected to said bottom member and having a pair of axially extending, laterally opposed upstanding edge boundaries, said upstanding wall having an interior surface and an exterior surface to anchor said assembly in said soil, said exterior surface comprising two sets of arcuately shaped gripping ribs, each set being circumferentially spaced from the other along said exterior surface, each set comprising a plurality of said gripping ribs provided in axially spaced rows, each of said gripping ribs comprising an inclined top wall sloping upwardly proceeding radially inwardly from said exterior surface toward said interior surface and each said rib having a generally horizontal bottom wall, wherein said assembly includes an imaginary horizontal plane passing therethrough parallel to said bottom wall, said top wall of said gripping rib being inclined at an angle of about 30–60° relative to said plane, and further comprising a plurality of axially spaced radially protruding fin members formed in said exterior surface and located between said two sets of gripping ribs wherein each of said radially protruding fin members comprises a fin top wall member sloping upwardly proceeding radially inwardly from said exterior surface toward said interior surface.

2. Window well assembly as recited in claim 1 wherein said rows of gripping ribs in one set are arranged in a common horizontal plane with said rows of gripping ribs in the other set.

3. Window well assembly as recited in claim 1 wherein said top rows of said gripping ribs are inclined at an angle of about 45°.

* * * * *